US005630451A

United States Patent [19]

Bernard

[11] Patent Number: 5,630,451

[45] Date of Patent: May 20, 1997

[54] OIL CHANGE APPARATUS

[76] Inventor: Aaron L. Bernard, 122 Fairway Dr., Lafayette, La. 70506

[21] Appl. No.: 365,565

[22] Filed: Dec. 23, 1994

[51] Int. Cl.[6] ..... B65B 1/04; B65B 3/04

[52] U.S. Cl. ..... 141/10; 141/313; 141/317; 141/382; 141/384; 141/387; 184/1.5

[58] Field of Search ..... 141/10, 98, 313, 141/314, 317, 382, 383, 384, 387, 391; 184/1.5

[56] References Cited

U.S. PATENT DOCUMENTS

| | | | |
|---|---|---|---|
| 3,727,638 | 4/1973 | Zaremba et al. | 184/1.5 |
| 3,806,085 | 4/1974 | Codo | 184/1.5 |
| 4,086,981 | 5/1978 | Mitsui | 184/1.5 |
| 4,269,237 | 5/1981 | Berger | 184/1.5 |
| 4,709,722 | 12/1987 | Knapp | 184/1.5 |
| 4,756,349 | 7/1988 | Atkins | 184/1.5 |
| 5,048,578 | 9/1991 | Dorf et al. | 141/384 |
| 5,259,588 | 11/1993 | Crosby, Jr. et al. | 184/1.5 |
| 5,407,177 | 4/1995 | Lombardo | 184/1.5 |

*Primary Examiner*—Henry J. Recla
*Assistant Examiner*—Timothy L. Maust
*Attorney, Agent, or Firm*—William W. Stagg

[57] ABSTRACT

An oil drain assembly for an engine oil pan to replace the plug of the oil pan drain opening comprising a valve housing having an upper oil inlet port mounted to and in communication with the drain opening of the engine oil pan; a lower oil outlet port; a means for controlling oil flow through the valve housing; a detachable drain line at the oil outlet port; and a detachable disposable oil collection bag mounted to the drain line.

6 Claims, 3 Drawing Sheets

OIL CHANGE APPARATUS

FIELD OF INVENTION

The present invention generally relates to the field of oil changes for internal combustion engines and more particularly relates to an apparatus for facilitating the changing of engine oil in internal combustion engines to encourage recycling of the used oil.

BACKGROUND OF INVENTION

In the field of internal combustion engines, especially automobile engines, it is necessary to remove and replace the engine lubricating oil after a period of time, usually between 3,000 and 7,000 miles of driving in the case of automobile engine oil. When the oil is changed by the engine owner at his home, the used and dirty engine oil is often disposed of in an environmentally unsafe manner such as by dumping the used oil down storm sewers or onto vacant lots or fields.

Even if oil collection centers are available for proper disposal and recycling, changing engine oil is usually a messy and dirty job. The person doing the job will simply want to dispose of the oil in the easiest manner which often is simply the dumping described above. This disposal by dumping creates environmental hazards and the cost of cleaning up these hazards becomes a public problem. In addition, when the used oil is disposed of by dumping, the oil is lost and not available for recycling. A need exists for a convenient way to remove and store used engine oil so that it may be handled easily and cleanly to encourage recycling and proper disposal of the used oil.

SUMMARY OF INVENTION

The present invention provides an apparatus designed to satisfy the aforementioned needs. It is comprised of a drain assembly which may be attached to the engine oil pan in place of the oil pan drain plug. Such oil pans are typical to automotive engines and other internal combustion engines which require oil for lubrication such as those used in lawn mowers, snowmobiles, jet skis and the like.

The drain assembly is comprised of a threaded oil inlet port for mounting the assembly directly to the engine oil pan in the place of the oil pan plug, an oil outlet port, a valve for controlling the oil flow, a hose connector for mounting a removable drain hose over the outlet port and an oil storage bag connected to the drain hose. In use, the oil drain assembly is mounted to the engine oil pan in place of the oil pan plug. When it is time to change the oil, a hose having an oil collection bag is attached over the oil outlet port, the oil flow valve is opened to allow the used oil to drain from of the oil pan down the hose and into the collection bag. When the oil pan has been drained, the valve is closed, the hose and bag is removed and clean engine oil may be added to the engine. The used oil is contained in the collection bag which may be brought to a disposal facility for proper disposal and recycling.

DESCRIPTION OF PREFERRED EMBODIMENT

Figure 1:
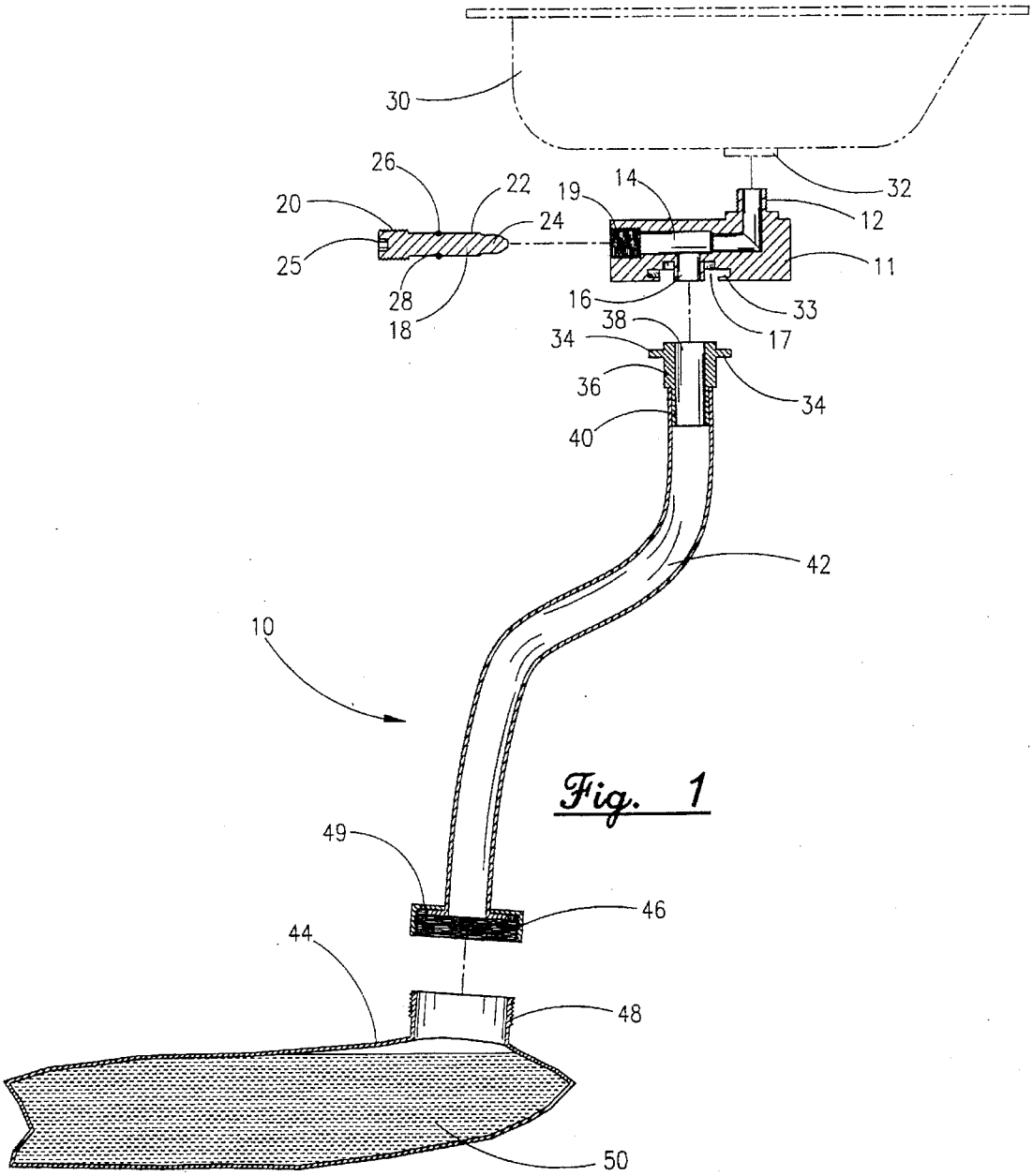
FIG. 1 is an exploded cross-sectional view of the oil drain assembly.

Referring now to the drawings and more particularly to FIG. 1 there is shown an exploded cross-sectional view of the preferred embodiment of the oil drain assembly 10. The drain assembly 10 is comprised of a longitudinal housing 11. The housing 11 has a central oil flow line 14, running along its length. An upwardly protruding threaded oil inlet part 12 penetrates the housing 11 at one end and downwardly protruding oil outlet port 16 penetrates the housing 11 at its other end, both in communication with the oil flow line 14.

Flow through the oil flow line 14 to the oil outlet port 16 is controlled by a valve stem 18. The valve stem 18 has a threaded neck 20, a shoulder segment 22 and narrower needle lead end 24. The housing 11 has a threaded opening 19 centered along the line of the oil flow line 14 to screwably receive the valve stem 18 by means of the threaded neck 20. The flow line 14 is designed to receive the valve stem 18 and the diameter of the line 14 is substantially the same diameter as that of the valve stem shoulder 22.

An O-ring 26 is positioned in a groove 28 on the periphery valve stem shoulder 22 to seal the flow space between the valve stem shoulder 22 and the flow line 14. The valve stem 18 has a multi-sided wrench socket 25 at the base of the threaded end to receive the head of an Allen wrench or other multi-sided wrench head so that the valve stem 18 can be turned and tightened in the opening 19 of the housing 11.

The oil inlet port 12 is designed to mount the housing 11 to the oil pan 30 by replacing the threaded oil pan drain plug of the oil pan 30. The diameter and thread dimensions of the inlet port 12 may vary depending upon the dimensions of the drain opening 32. The housing 11 is screwably mounted to the oil pan 30 by means of the threaded oil inlet port 12 and the drain opening 32.

Incorporated into the housing 11 is a recessed area 17 around the oil outlet port 16 forming a pair of connector slots 33 on opposite sides of the port 16. The connector slots 33 are designed to receive the flanges 34 of a drain line connector 36. The flanges 34 are located on opposite sides of the connector 36 and sized to fit into slots 33. The drain line connector 36 has an inlet bore 38 which is slipped over the oil outlet port 16 and an outlet nipple 40 over which an oil drain line 42 is attached by friction or by other means. The oil drain line 42 is in turn attached to a disposable sealable oil collection bag 44 by friction connector or other means such as a threaded screw cap 46 and threaded port 48. The screw cap 46 may have an air hole 49 to facilitate filling the bag 44 with oil.

Figure 6:
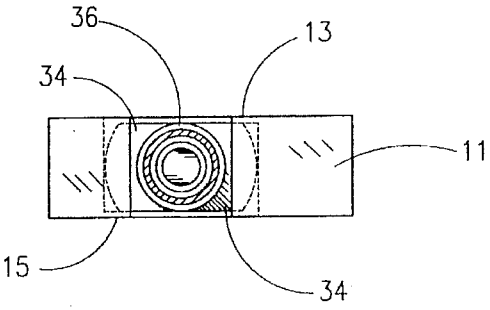
FIGS. 5 and 6 are bottom views of the oil drain assembly showing the placement of the drain line connector.
Figure 5:
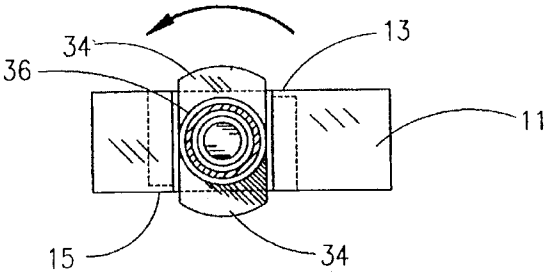

As shown in FIGS. 5 and 6, the connector 36 is secured to the housing 11 by positioning the connector flanges 34 perpendicular to the connector slots 33 and turning the connector ninety degrees to align the connector flanges 34 in the slots 33. Stops 13 and 15 on the housing 11 prevent the connector flanges from rotating more than ninety degrees in the slots 33.

Figure 2:
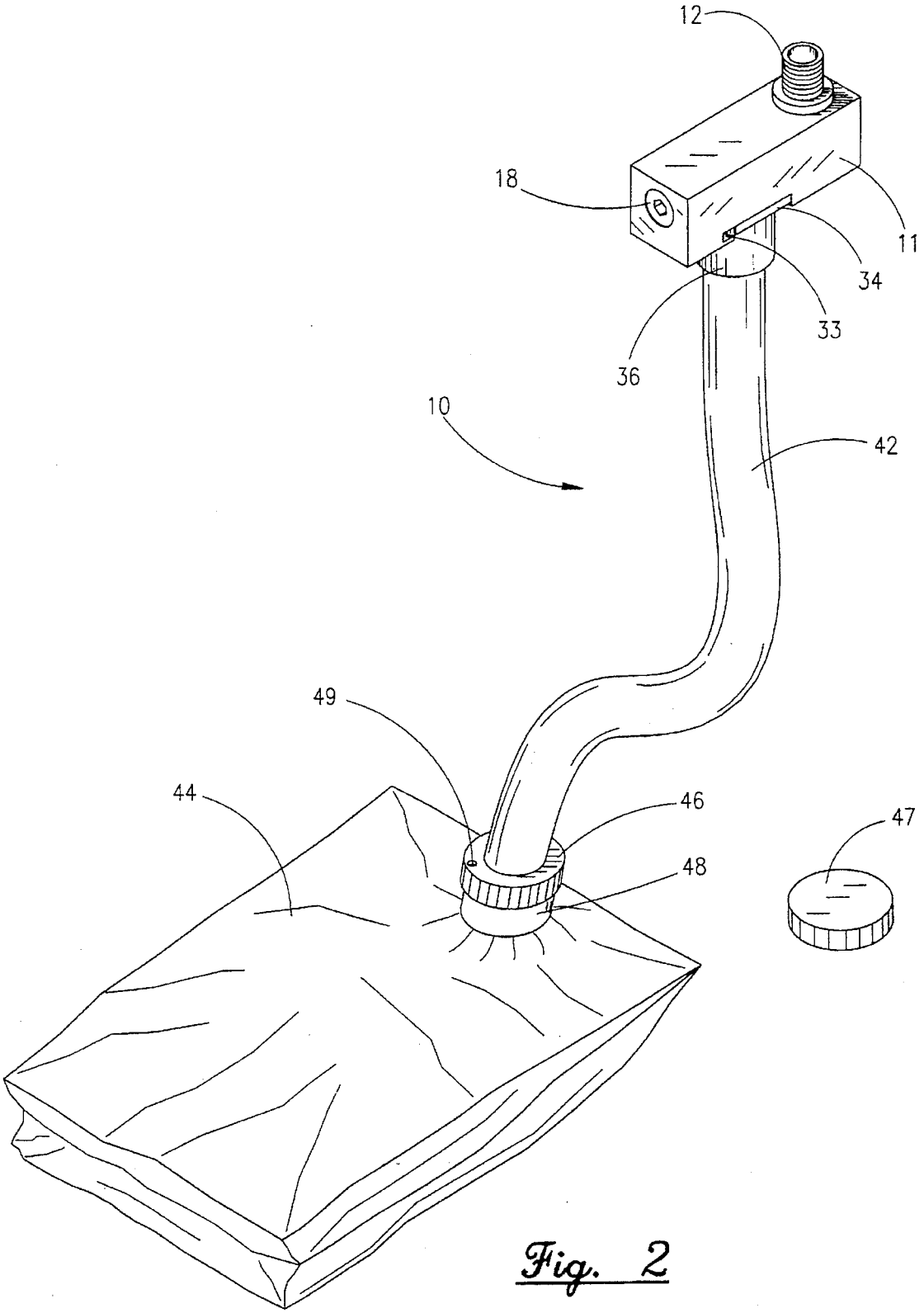
FIG. 2 a perspective view of the oil-drain assembly.
Figure 3:
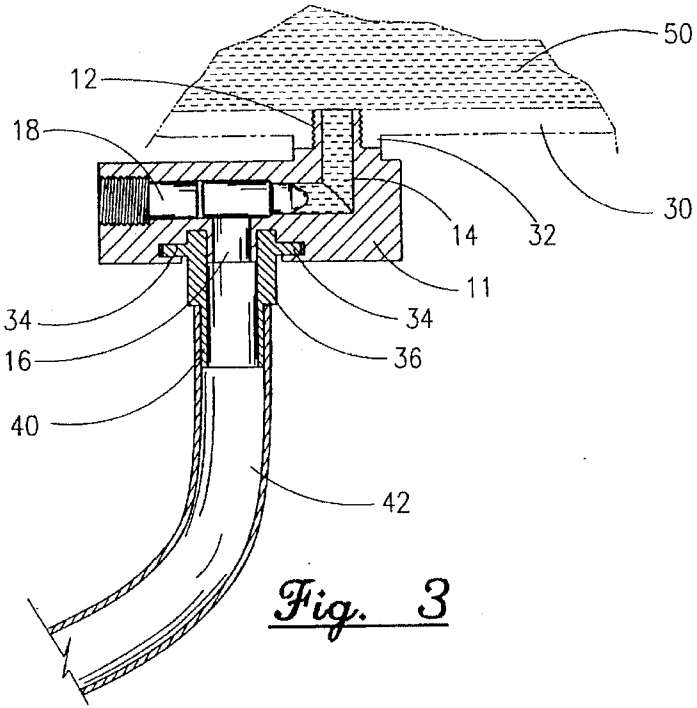
FIG. 3 is a partial cross sectional view of the drain assembly with the valve stem closed.

The entire assembly 10 for mounting to a typical oil pan is shown in FIG. 2. To use the oil drain assembly 10 to facilitate the remaining oil 50 from an oil pan 30 of an internal combustion engine, the housing 11 of the assembly 10 is screwably mounted to the oil pan 30 at the oil pan drain opening 32 by means of the threaded inlet port 12, in place of the oil pan drain plug normally utilized. The valve stem 18 is tightened within the housing 11 to seal the oil flow line 14. As shown in FIG. 3, while the engine is used, the housing 11 is left in place on the oil pan 30.

When the engine oil 50 is to be replaced, the connector 36 is attached to the assembly housing 11 over the oil outlet port 16 as described above and shown in FIGS. 5 and 6. The drain line 42 with the attached collection bag 44 may be attached to the connector 36 at the outlet 16 either before or after the connector 36 is attached to the housing 11.

Figure 4:
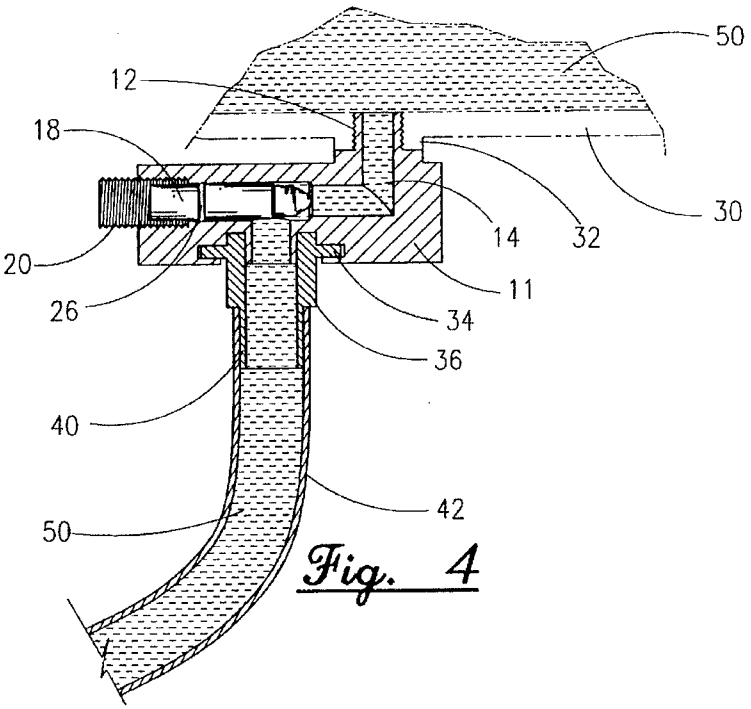
FIG. 4 is a partial cross sectional view of the drain assembly with the valve stem open.

An Allen wrench or other multi-sided wrench head is inserted into the wrench socket 25 to turn the valve stem 18 to allow flow of the old engine oil 50, as shown in FIG. 4, through the oil inlet port 12, the oil flow line 14 and the oil outlet port 16 down the drain line 42 to the collection bag 44. When the oil 50 has finished draining from the oil pan 30, the valve stem 18 is turned in the opposite direction to close the flow line 14. The connector 36 and drain line 42 are then removed by reversing the process described above for attaching the connector. The collection bag 44 is then sealed by cap 47 and the used oil may be brought to an oil collection facility for proper disposal or recycling.

Ideally, the collection bag 44 and its components are made from disposable and recyclable plastic. The drain line 42 and the connector 36 are also preferably made of plastic though other materials may be utilized.

The various components of the assembly 10, including the collection bag 44, can be sized to accommodate the engines used on various devices such as lawn mowers, lawn tractors, snowmobiles, jet skis and such devices. The assembly 10 can also be sized for use on automobile engines, truck engines, tractors and the like. The assembly 10 is designed to be mounted onto the oil pan of existing engines by having the threaded protruding inlet port 12 screw directly into the oil pan drain hole 32 in place of the oil pan drain plug. However, for new engines, the oil pan can be redesigned to incorporate the features of the drain assembly disclosed herein and thereby eliminate altogether an oil pan drain plug.

It is thought that the oil drain assembly and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the form described herein being merely a preferred or exemplary embodiment of the invention.

I claim:

1. An oil pan drain assembly, adapted to be screwably mounted to an oil pan of an internal combustion engine having a threaded oil pan drain hole, in place of the threaded oil pan drain hole plug, comprising:

a) a housing, said housing extending along a longitudinal axis between first and second housing ends and having upper and lower housing surfaces, said housing having an internal longitudinal oil flow space between said first and second housing ends and a threaded bore at said first end of said housing, said threaded bore being aligned and in communication with said oil flow space;

b) an oil inlet port protruding upward from said upper surface of said housing, said oil inlet port having an opening in communication with said internal oil flow space of said housing, said oil inlet port having external threads around its periphery so that said oil inlet port is adapted to be screwably received into an oil pan drain hole for mounting said housing to said oil pan;

c) a protruding oil outlet port extending downward from said lower surface of said housing in communication with said internal oil flow space of said housing;

d) a longitudinally extending valve stem having a base end and a lead end, said valve stem having a needle end lead segment, a shoulder segment corresponding in length to said internal flow space of said housing and of substantially the same diameter as said internal oil flow space and a threaded neck segment for screwably engaging said valve stem with said threaded bore at said first end of said housing so as to position said shoulder segment of said valve stem within said internal flow space of said housing to seal said flow space;

e) a means for rotating said valve stem;

f) first and second asymmetrical connector slots integral with said housing, each of said connector slots having an open end and a closed end, said a first and second connector slots being positioned transverse to said longitudinal axis of said housing adjacent to and on opposite sides of said oil outlet port so that said closed end of said first connector slot is adjacent to said open end of said second connector slot;

g) a detachable drain hose, said drain hose having first and second ends, said first hose end having a pair of opposing flanges extending perpendicular from said first hose end, said first hose end being adapted for receiving said oil outlet port and said flanges being adapted for rotational engagement with said first and second connector slots for attachment and detachment of said drain hose with said oil outlet port;

h) a detachable oil collection bag;

i) means for detachably mounting said drain hose to said oil collection bag at said second hose end.

2. The oil pan drain assembly recited in claim 1, wherein said valve stem includes O-rings mounted around said shoulder segment of said valve stem.

3. The oil pan drain assembly recited in, claim 2, wherein said base of said valve stem has a multi-sided socket for receiving a multi-sided wrench head.

4. The oil pan drain assembly recited in claim 3, wherein said oil collection bag is made of recyclable plastic.

5. The oil pan drain assembly recited in claim 4, wherein said drain line is plastic.

6. The oil pan drain assembly recited in claim 1, wherein said oil collection bag is disposable.

* * * * *